United States Patent [19]

McCluskey et al.

[11] Patent Number: 4,752,060

[45] **Date of Patent: * Jun. 21, 1988**

[54] SUPPORT DEVICES FOR STANCHIONS

[75] Inventors: John R. McCluskey, R.D. Box 154A, West Coxsackie, N.Y. 12192; Ralph R. Edwards, Briarcliff Manor, N.Y.

[73] Assignee: John R. McCluskey, West Coxsackie, N.Y.

[ * ] Notice: The portion of the term of this patent subsequent to Jul. 2, 2003 has been disclaimed.

[21] Appl. No.: 189,192

[22] Filed: Sep. 22, 1980

Related U.S. Application Data

[60] Continuation of Ser. No. 950,596, Oct. 11, 1978, abandoned, which is a continuation of Ser. No. 828,830, Aug. 29, 1977, abandoned, which is a division of Ser. No. 462,314, Apr. 19, 1974, Pat. No. 4,045,003, which is a continuation-in-part of Ser. No. 341,131, Mar. 14, 1973, abandoned.

[51] Int. Cl.[4] ..... E04H 17/14

[52] U.S. Cl. ..... 256/59; 256/DIG. 6

[58] Field of Search ..... 403/227, 372; 411/34; 256/DIG. 6, 59, 65

[56] References Cited

U.S. PATENT DOCUMENTS 3,420,013 1/1969 Alvarado ..... 52/161

3,764,177 10/1973 Woodward ..... 403/227 X

FOREIGN PATENT DOCUMENTS 1248595 11/1960 France ..... 403/227

858803 1/1961 United Kingdom .

*Primary Examiner*—Andrew V. Kundrat

*Attorney, Agent, or Firm*—Philip Furgang

[57] ABSTRACT

Disclosed is a stanchion support device which comprises a washer having secured thereto a threaded column. About the threaded column is a toroidal collar of hard rubber. Placed over the threaded column is a metal sleeve. Threaded onto the threaded column is a nut which forces the metal sleeve downward against the rubber collar and pulls upwardly on the washer. The combined force of the sleeve and washer causes the rubber to expand. When this combination is placed within a cavity, such as may be defined by a cup placed in a cement floor, the rubber is so dimensioned as to engage the cup wall, thereby securing the stanchion support device within the cup. A stanchion may be secured to the nut. The stanchion itself may be provided with one or more L-shaped brackets which are freely rotatable thereupon and retained from sliding down the stanchion by a support, such as a ring, welded to the stanchion. An enlarged head of the stanchion prevents the removal of the bracket off the top of the stanchion.

5 Claims, 3 Drawing Sheets

SUPPORT DEVICES FOR STANCHIONS

REFERENCE TO APPLICATIONS

This application is a continuation of application Ser. No. 950,596, filed on Oct. 11, 1978, now abandoned, which was, in turn, a continuation of application Ser. No. 828,830, filed on Aug. 29, 1977, now abandoned, which was, in turn, a divisional application of application Ser. No. 462,314, filed Apr. 19, 1974, and issued as U.S. Pat. No. 4,045,003 on Aug. 30, 1977, which was, in turn, a continuation-in-part of application Ser. No. 341,131, filed on Mar. 14, 1973, now abandoned.

BACKGROUND OF THE INVENTION

This invention relates to support devices and in particular a support for protective devices used as guard rails, scaffolding, or the like.

Guard rails, hand rails, scaffolding, and the like are protective and supportive devices used around work areas, in connection with construction, and in protecting workers from dangerous machinery and other dangerous situations. In many instances such guard rail devices are temporary in nature, intended to be used only during periods of construction or installation of machinery. On other occasions, such guard rails are more permanent, meant to remain in place for long periods of time. In terms of the overall discussion of scaffolding, guard rails, and the like, it is to be understood herein that the term "stanchion" may refer generically to either vertically upright or horizontal members used in guard rails, scaffolding, and the like.

At the heart of any efficient stanchion, it is desirable to provide ones which are easily installable, may be used for long periods of time (even permanently), and, where desired, may be easily removed.

The disposition of guard rails around the perimeter of work areas has long been used and many arrangements have been suggested. The most common type of guard rail is often improvised and jerry-built. Recently, however, governmental agencies at various levels have begun to specify safety precautions along most work and building sites. Amongst these provisions is the Federal Goverment's Occupational Health and Safety Act (OHSA), which specifies not only the height of guard rails, but their rigidity and general configuration. Much of the present guard rails are not in conformance with these regulations or are too expensive for economical use.

One suggested guard rail was disclosed by Lionetto in U.S. Pat. No. 3,662,993. That device calls for stanchions which are wedged between upper and lower floors. The difficulty with a design such as this is that, in the first place, it requires an opposed upper floor. Secondly, the use of two bearing surfaces requires an uneconomical combination of parts in order to secure the railings to the site. Thirdly, the protective device cannot be left permanently on the site. Furthermore, it is doubtful that such a device would be absolutely secure, particularly if the opposed floors are uneven or if the screw jack combination is not sufficient to provide uniform and continuous pressures.

Still another suggested type of guard rail was provided by Melfi in U.S. Pat. No. 3,351,311. In this arrangement, there is provided a C-clamp for surrounding and engaging a cement floor. However, such a device tends to pivot about the point of engagement (that is, at the contact of the C-clamp with the floor). In addition, variation in floor sizes may require different size C-shaped clamped for practical engagement, thereby rendering such an arrangement complicated and expensive in use.

One other suggested means of engaging a post in a rail, or a rail in a floor, was disclosed by Macrea in U.S. Pat. No. 406,657. Macrea provides an end of a rail having two sleeves pivotally mounted for expansion within a frusto-conically-shaped cavity in a post. For this device to work, however, the cavity had to be especially designed with its special shape, and the grip of the rail would not be believed to be too secure, in any event. So that if such a post and rail combination were used with the railing taking the form of a stanchion, and having to support a guard rail, it would be weak and insecure.

All of the suggested devices herein, and other similar devices, are believed to be either permanent or of temporary design. None have the flexibility to be used as both permanent or temporary installations. This lack of flexibility adds to their cost and inconvenience of use.

In the past, brackets for supporting railings have been rigidly secured to stanchions. Thus, McCarthy in U.S. Pat. No. 791,713 shows a typically rigid, rail-holding brackets which are integral with the stanchion. This means that if the stanchion must be partially removed (so as to admit equipment to a work area, for example) the railings will have to be removed from the stanchion before removing the stanchion itself. This problem is further compounded where the stanchion is removed by rotation. A rigid bracket will obviously rotate with the stanchion thereby necessitating the removal of the railings.

Bettis, in U.S. Pat. No. 57,073 suggests brackets which are held in place by a wedge. Removal of the wedge, however, would necessarily result in the bracket dropping down the stanchion making more difficult removal of the stanchion. Williams, in U.S. Pat. No. 1,864,159 suggests a guard rail in which the brackets are rings held to the post by set screws. A loosening of the set screws would necessarily result in the dropping of the bracket thereby making removal of the rail more difficult.

SUMMARY OF THE INVENTION

It is an object of this invention to provide a support device for supporting a stanchion, or the like, which is easily insertable and removable from a work area.

It is an object of this device to provide a reusable support device for supporting a stanchion or the like.

It is a further object of this invention to provide a support device for stanchions or the like which may form part of either a temporary or permanent installation.

In fulfillment of these objectives, there is provided a support means for stanchions or the like of the type having at least a portion thereof insertable within a cavity of a predetermined configuration. Support means comprises a base means which can be inserted into the cavity. An expansible means is provided upon the base means and is also insertable within the cavity. Finally, there is provided an engaging means which is coupled to the support means. When the engaging means is caused to move towards the base means upon the support means, both the engaging means and the base means exert compression forces upon the expansible means, thereby causing the expansible means to engage the cavity walls and secure therewithin the support means.

In one aspect of this invention, the base means comprises a waser and a vertically threaded rod, the expansible means is a rubber toroidal collar upon the support means and the engaging means may be a metal sleeve and nut. The nut screws down upon the sleeve forcing it against the rubber collar and pulling up on the washer, thereby causing the rubber collar to expand and engage the walls of the cavity.

A BRIEF DESCRIPTION OF THE DRAWING

DESCRIPTION OF THE PREFERRED EMBODIMENTS

Figure 4:
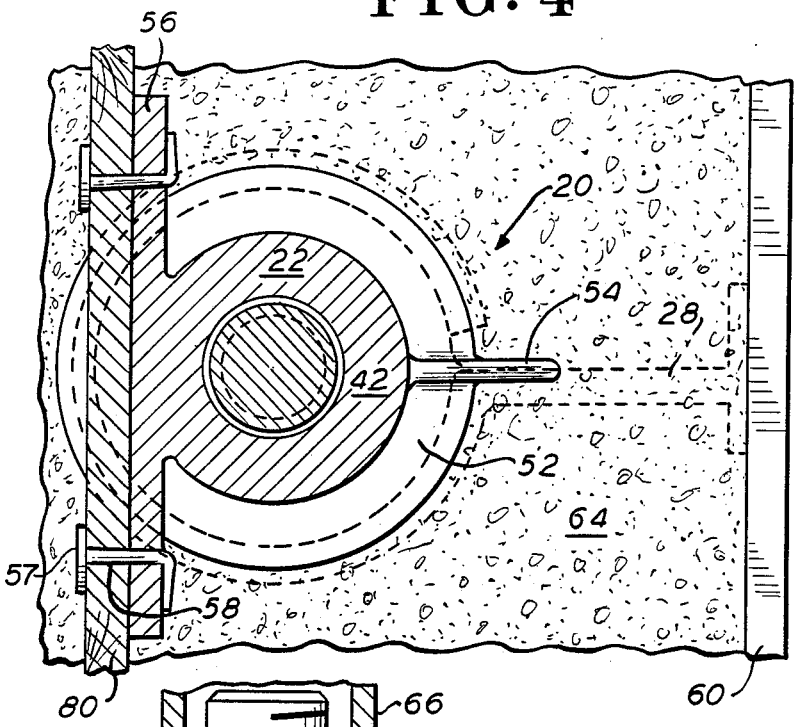
FIG. 4 is a sectional view of the stancion support device of FIG. 1 taken along line 4—4.
Figure 5:
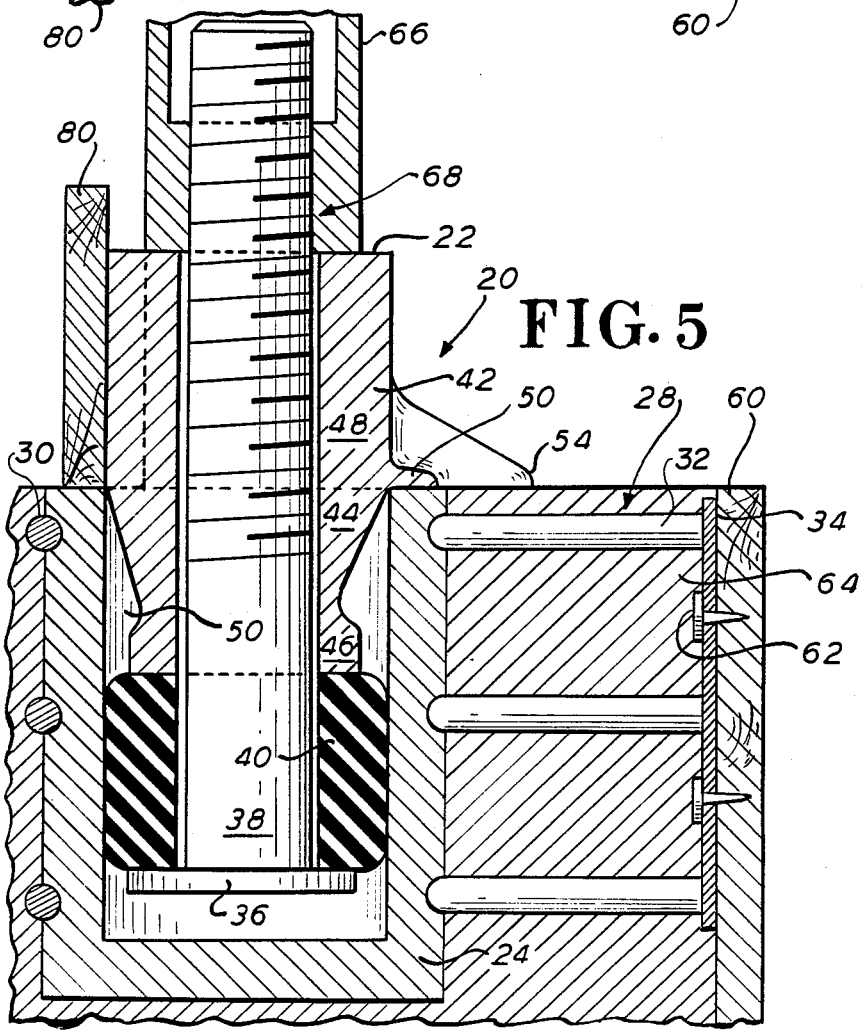
FIG. 5 is a partial sectional view of the stanchion support device of FIG. 1 taken along line 5—5.

As has been previously indicated, "stanchion" as used herein means any post, scaffolding, or similar device for supporting any guard rail, scaffolding member, whether horizontal or vertical in orientation. Turning to the drawing, there will be seen (FIGS. 1, 4, and 5) one type of support device 20 for securing a stanchion. There are provided male 22 and female 24 members. The female member 24 may comprise a cup-like member 26 and a mounting bracket 28. The cup 26 may have any desired shape. Thus, as shown it may be cylindrical. On the other hand, the cup 26 may be replaced with a cavity or other opening in a work area having any other desired shape as well. The function of the cup or the cavity will be more fully discussed below.

The cup 26 may be made of any structural material such as, for example, polyvinyl chloride. The cup 26 may have annular grooves 30 (FIG. 5) formed therein. The bracket 28 may have any desired shape, such as a question mark shape with the straight portion 32 terminating in a perpendicular and planar nail plate 34. As disclosed in FIG. 5, the bracket 28 may comprise three resilient members which may be made of, for example, wire joined to the nail plate 34 by welding or the like. Any other convenient shape may be used for a bracket.

The male portion 22 of the support device 20 comprises a plate 36. The plate 36 may take the form of a washer of heavy guage steel, for example. The plate member 36 conforms generally to the interior configuration of the cup 26. Secured to the plate member 36 by welding, casting, or the like may be a centrally disposed rod-like member 38. This rod-like member 38 may take the form, for example, of a threaded steel rod. Placed over this rod 38 and resting upon the washer 36 may be a toroidal collar 40 of expansible material. Thus, resilient material may be used, such as, for example, vinyl, neoprene, or rubber.

Disposed on top of the collar 40 and about the rod 38 and movable with respect thereto, is a sleeve 42. The sleeve 42 may be hollow and substantially annular. The sleeve 42 may have a neck portion 44 which terminates in a small, marginal edge flange 46. The neck portion 44 extends from the marginal flange 46 outwardly to a body portion 48 of the sleeve 42. Both the neck portion 44 and flange 46, and the collar 40 that it abuts, are so dimensioned as to fit easily within the cup 26. The juncture of the neck 44 with the body portion 48 of the sleeve 42 may be so dimensioned as to contact the inner wall 50 of the cup 26.

The body portion 48 of the sleeve 42 may have any shape suitable to fit within an opening. Thus, as shown, it may be substantially cylindrical in shape and extend upwardly along a portion of the rod 38. A radially extending flange 52 is provided on the body portion 48 and rests upon the mouth of the cup 26. A tang 54 extends radially outwardly and terminates in the same radial plane as the radial flange 52. The purpose of the radial flange 52 and tange 54 will be more fully discussed below.

Opposed to the tang 54 and extending outwardly, as a tangent from a circle, is a toe board nail plate 56. The toe board nail plate 56 extends to either side of the body portion 48 of the sleeve 42 and may have apertures 58 (FIG. 4) for admitting nails therethrough.

In assembly, the cup 26 is placed in an area which may be cemented in. The bracket 28 is placed about the cup 26 in the annulr grooves 30. The nail plate 34 may then be nailed to the form board 60 by means of nails 62. The distance of the cup 26 from the form board 60 is arbitrary and is made to conform with any desired distance or existing statutory requirements of spacing a guard rail from the edge of a work area. Generally, if the support device is employed where, for example, cement floors are being laid, the cups 26, as indicated, are pre-set in place. Cement 64 is then floated into place. After the cement 64 has set, the male member 22 of the support device 20 is placed within the female member cup 26. At this time, the collar 40 is spaced from the inner wall 50 of the cup 26. A stanchion 66 (FIGS. 1 and 5) may have an integral nut or other engaging mens 68 secured at one end. The nut 68 may be threaded on the threaded rod 38. It will be noted that the support rod 38 extends only a short distance within the stanchion 66. As the stanchion 66 is tightened downwardly, the sleeve 42 presses upon the collar 40. Threading down upon the rod 38 causes the plate 36 to pull upwardly thereby applying forces to both sides of the collar 40. In response to the forces the collar 40 expands to engage the wall 50 of the cup 26. Thus engaged, a stanchion 66, or other device, may be locked in place either permanently or temporarily and easily removed by unthreading the stanchion 66.

Figure 1:
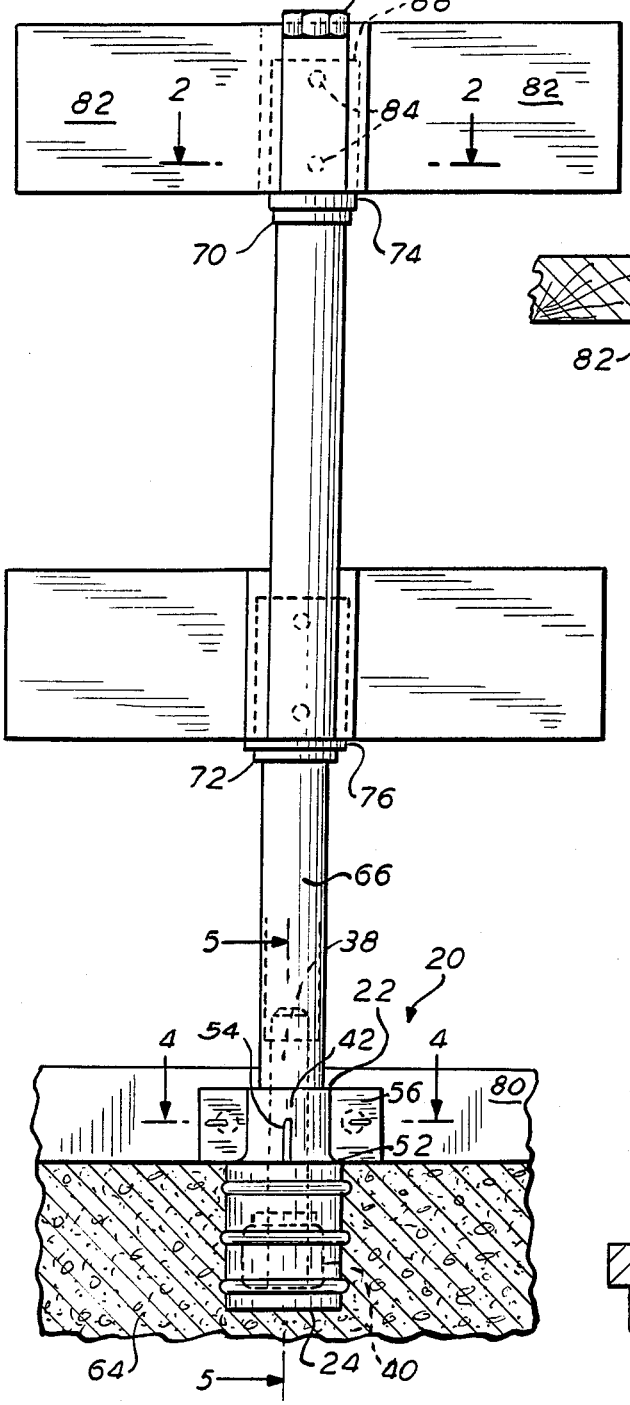
FIG. 1 is a plan view of a support device and stanchion, all constructed in accordance with the teachings of this invention.
Figure 2:
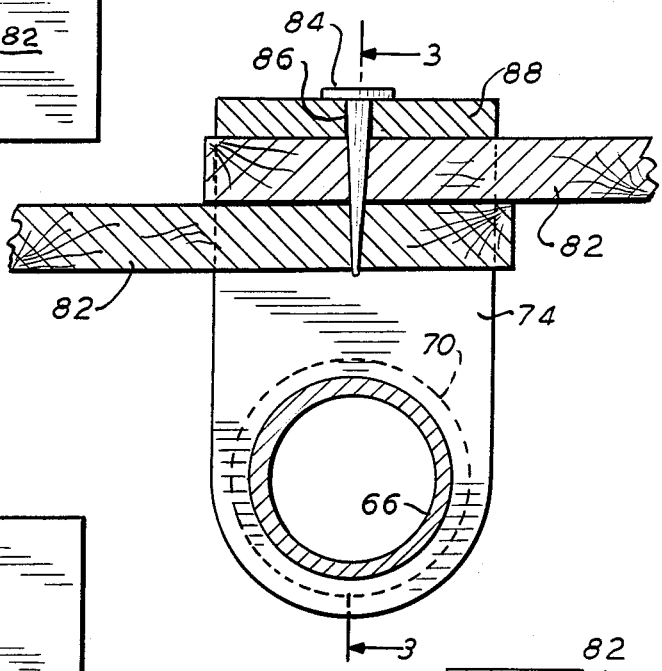
FIG. 2 is a sectional view of the stanchion of FIG. 1 taken along line 2—2.
Figure 3:
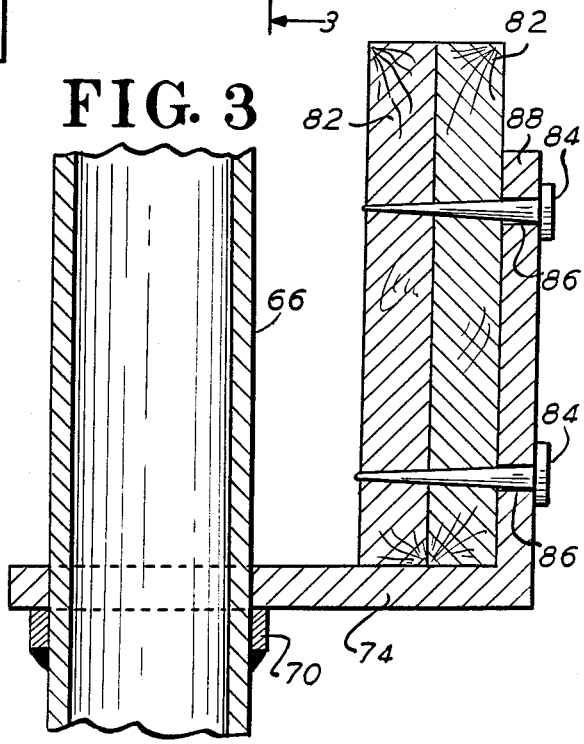
FIG. 3 is a partial sectional view of the stanchion of FIG. 1 taken along the line 3—3 in FIG. 2.

Disposed at various points along the stanchion 66 may be collars 70 and 72 (FIGS. 1, 2, and 3). The collars 70 and 72 may be secured to the stanchion 66 by welding or the like. Disposed about the stanchion 66 and residing upon the collars 70 and 72 are planar L-shaped rail support members 74 and 76, respectively. The L-shaped rail support members 74 and 76 are rotatably secured upon the stanchion 66 and held in place by the collars 70 and 72, respectively. The stanchion 66 has at the end opposed to the end having an integral nut 68, a hex nut 78. The hex nut 78 may be made of any common material, such as steel, and may be welded or formed as an integral part of the stanchion 66.

In use, the cup 26 is placed in an area which is to be flooded with concrete 64 or the like. The bracket 28 is placed about the cup 26 and its nail plate 34 is secured against a form board 60 by nails 62. The distance from the cup 26 to the nail plate 34 may be the prescribed distance from the edge of a work area as set forth by statutory requirements (e.g., OHSA) or, in the alternative, any distance that is required or desired. The concrete 64 is next floated into place and permitted to harden. As a next step, the assembly which includes the support plate 36, rod 35, collar 40, sleeve 42, are lowered into the cup with the flange 52 resting on the lip or marginal edge of the cup 26. A plurality of these cups 26 with their male insert portions 22 may be disposed along a particular path adjacent the edge of a work area (not shown). Nails 57 (FIG. 4) may then be driven through the apertures 58 in the nail plate 56 into the toe board 80. Nailing the toe board 80 to the nail plate 56 of the sleeve 42 helps to orient and fix the sleeve 42 in place. Next, the stanchion 66 is lowered into place and the integral nut 68 engages the threaded rod 38 and is tightened downwardly thereon. In turning the stanchion 66, the hex nut 78 may be engaged by a wrench or the like (not shown) and the entire member tightened in that manner.

As shown in FIG. 1, the arms 74 and 76 may be perpendicular the toe board 80. However, any other arrangement may be employed. Generally, these arms 74 and 76 are used to hold boards (or guard rails) 82 which are secured in place by, for example nails 84 driven through nail holes 86 in the upright arms 88. It will be noted that the boards 82 terminate on each arm 74 and 76 so that a continuous smooth guard rail is formed between standing stanchions 66 (only one is shown).

The brackets or arms 74 and 76 are freely rotatable upon the stanchion 66. Thus, the stanchion 66 may be rotated for removal or installation independent of the position of the brackets 74 and 76. This is particularly useful when the stanchion 66 is to be removed to admist machinery to a work area. The stanchion 66 can be removed while the brackets 74 and 76 remain substantially stationary. The stanchion 66 is then lifted with the railings or boards 82 in place, thereby saving time. The collars 70 and 72 prevent the brackets 74 and 76, respectively, from slipping downwardly under the weight of the boards 82 as the stanchion 66 is lifted.

Figure 6:
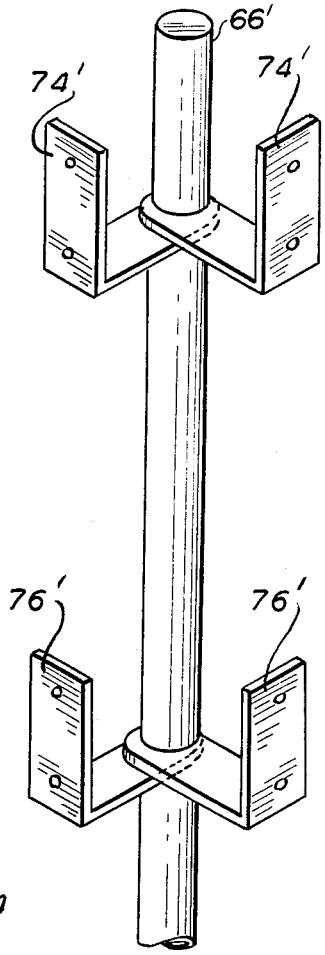
FIG. 6 is a perspective view of a stanchion constructed in accordance with the teachings of this invention.

If guard rails were to be installed at corners, as for example about a shaft on a site of construction, a stanchion 66' (FIG. 6) may have a plurality of such arms 74' and 76' thereon. Thus, (as shown in FIG. 6) the arms 74' and 76' may be located at the two desired levels. In this way, a stanchion may form the corner of guard rails which are at right angles to one another (not shown).

The tang 54 is used to steady the stanchion 66 and prevent it from swaying. The radial flange 52 and the toe board 80 serve the same function. Thus, a rigid and secure but temporary guard rail installation may be made. On the other hand, it should be understood that this installation may be left permanently in place. In this regard, the support device 20 may be altered to include more permanent types of guard rails as is commonly known in the art. It is to be understood as well, that while the cup 26 is regarded as an important aspect of this invention, it is also contemplated that if the cavity into which the male portion 22 of this invention is inserted were properly dimensioned, a separate or preformed cup would not be essential. Rather, the male portion 22 could be inserted into the female cavity (not shown).

The support device 20 of this invention may be modified for other types of guard rail support means.

Figure 7:
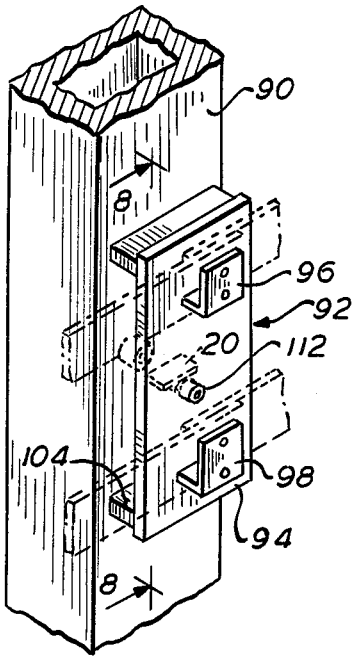
FIG. 7 is a perspective view of a support device and guard rail support means constructed in accordance with the teachings of this invention.
Figure 8:
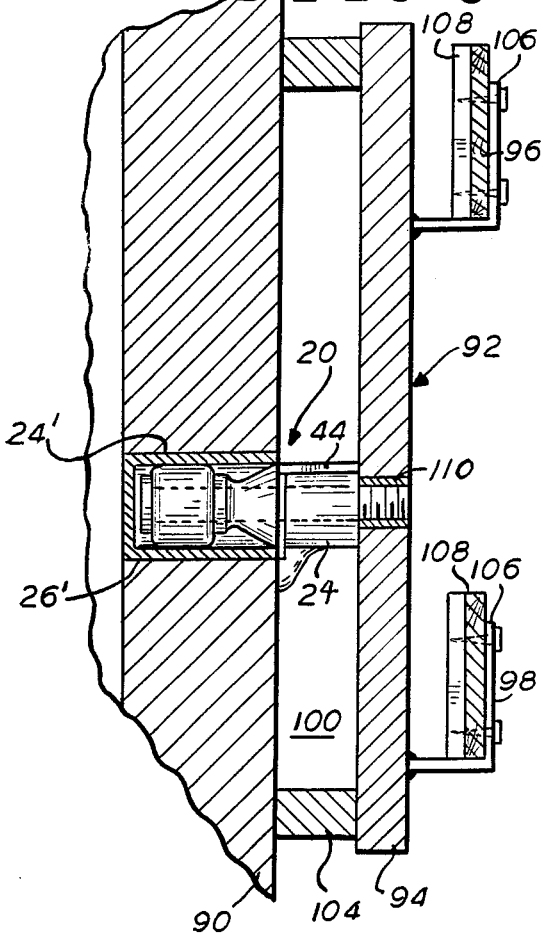
FIG. 8 is a sectional side view of the device of FIG. 7 taken along line 8—8.

In another approach, the support device 20 is shown used in combination with a column 90 (FIGS. 7 and 8). The female portion 26' comprises a cup 26'. The male portion 24' of the support device 20 may then be inserted into the cup 26' in the column 90 substantially perpendicular thereto. The stanchion 92 in this instance takes the form of a rectangular member 94. L-shaped arms 96 and 98 may be secured at appropriate positions on the rectangular member 94. The rectangular member 94 may be made of structural material such as steel and may have on the side 100 opposed to the side to which are secured the arms 96 and 98, a pair of opposed legs 104. The legs 104 may be joined thereto by welding or the like, and are intended to support the member 94 and space it from the column 90. One leg 106 of each of the L-shaped arms 96 and 98 is disposed spaced from the member 94 and parallel thereto, in order to engage and hold guard rails which may be, for example, in the form of wooden boards 108. The legs 104 space the member 94 from the column 90. The member 94 may be secured to the male member 22 by a nut 110 (which may be made of steel or the like), which is secured by welding or the like, to a centrally disposed aperture 112 in the member 94. To avoid having to rotate the member 94 while tightening the sleeve 44 and plate 36 against the collar 40, the nut 110 may be rotatably mounted in the member 94 in a manner well known in the art. It is not required that the member 94 be rectangular or that the arms 96 and 98 be L-shaped. The purpose of this device is to permit guard rails to be interconnected between columns or from a stanchion to a column.

Figure 9:
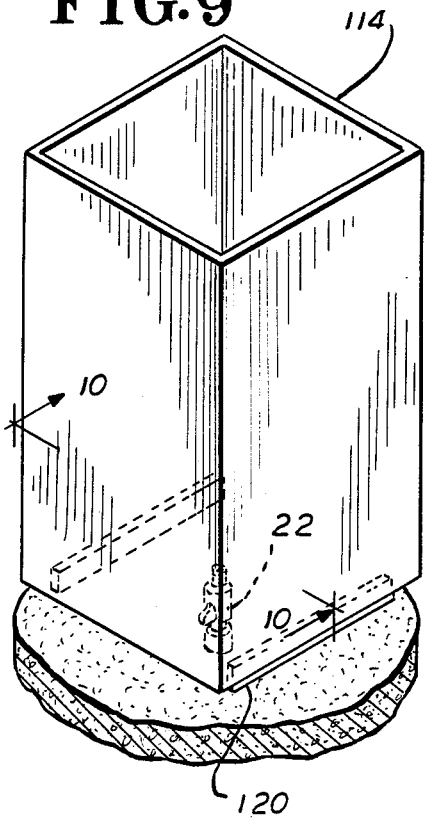
FIG. 9 is a perspective view of a device for holding a column and secured to a work area by a support device of the type shown in FIG. 1.
Figure 10:
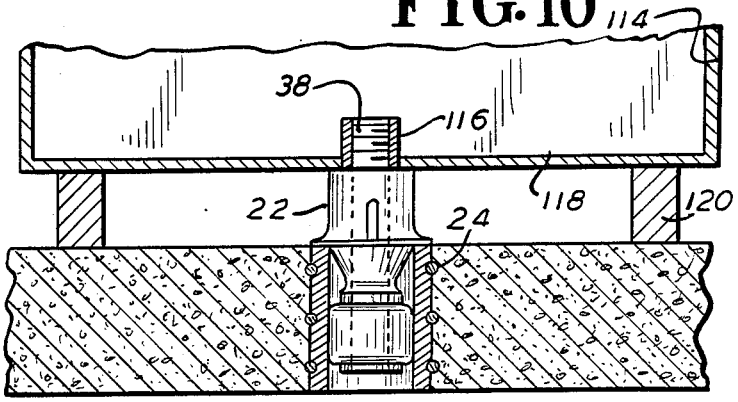
FIG. 10 is a partial sectional view of the device of FIG. 9 taken along line 10—10.

In another aspect of this invention (shown in FIGS. 9 and 10), a box-like member 114 may be secured to the threaded rod 38 of the male member 22 by means of a nut 116 centrally disposed in the bottom wall 118 thereof. Legs 120 may be secured to the bottom wall 118 to keep the box 114 upright. The box 114 is used to retain therein a column (not shown). Thus, for example, the box 114 may be made of any sturdy structural material such as steel. An ordinary wooden column, for example, one 4 inches by 4 inches, or any other desired dimensions, may be placed in the box 114 and rails nailed directly thereto (not shown).

While the preferred form of male and female members 22 and 24, respectively, have been disclosed herein (FIGS. 1–10), there may be other related male and female members in accordance with this invention. Several are discussed hereinbelow. It will be appreciated that any of the previous discussed stanchion members (see FIGS. 1–10) may be used in conjunction with any of the followed suggested devices.

It will be understood throughout that the shape of the male and female members may be altered to any desired or convenient shape—from cylindrical (as disclosed) to elliptical, rectangular, or the like. Further, it is also understood that the use of a threaded rod is not necessary and any other engaging means may be used in its place.

Not only may the type of support device and the type of stanchion supported thereby (compare FIGS. 1, 6, 7, and 9) be varied, but so may the manner of securing a female member to a work area. As disclosed thus far, a female member may be inserted into a hardenable material or be formed as an integral part thereof (as in precast cement planks).

We claim:

1. Support means for stanchions or the like of the type having at least a portion thereof insertable within a cavity, the cavity having a predetermined configuration, said support means comprising:

(a) means for being secured to the stanchion;

(b) base means for inserting within the cavity said base means comprises a rigid disk;

(c) expansible means upon said base means, for insertion within the cavity;

(d) engaging means coupled to said base means and expansible means; said engaging means further comprises a rigid member coupling said securing means and base means to said expansible means; such that upon said engaging means in combination with said rigid member exerts a force against said expansible means; said base means, in response to said engaging means and said rigid member, exerts a force against said expansible means; said combined forces thereby causing said expansible means to expand so as to be capable of engaging the cavity wall;

(e) means for supporting and holding said base, expansible, and engaging means with respect to one another for unitary removal from said cavity upon the releasing of said forces, said support means comprises a rigid element for joining said base means and said expansible means to said securing means without the cavity; said rigid element comprises a threaded rod, said expansible means comprises a toroidal collar of rubber about said threaded rod; said rigid member comprises a sleeve about said rod; said securing means further comprises means for joining the stanchion to said threaded rod and thereby forcing said sleeve against said collar; said joining means comprises a nut integrally joined with the stanchion and threaded upon said threaded rod, such that upon tightening said stanchion against said sleeve, said sleeve engages said collar, said flange portion of said sleeve having arms extending therefrom for securing thereto a toe board; said rigid member extending within the cavity and without so as to engage said expansible means and provide support to said rigid element with the cavity, said rigid member having an integrally formed laterally extending flange-like portion for bearing against the marginal edge of the cavity wall for keeping the support means from pivotally moving about the marginal edge; said base means and said rigid member are on opposed sides of said expansible means and said expansible means is easily insertable; within the cavity in a relaxed condition and returns to said relaxed condition upon removing said forces of said rigid member and said base means; said expansible means comprising resilient material.

2. Support means for stanchions or the like of the type having at least a portion thereof insertable within a cavity in a work area, the cavity having a predetermined configuration, said support means comprising:

(a) means for being secured to the stanchion;

(b) base means for inserting within the cavity;

(c) expansible means upon said base means, for insertion within the cavity;

(d) engaging means coupled to said base means and expansible means; said engaging means further comprises a rigid member coupling said securing means and base means to said expansible means; such that upon said engaging means in combination with said rigid member exerts a force against said expansible means; said base means, in response to said engaging means and said rigid member, exerts a force against said expansible means; said combined forces thereby causing said expansible means to expand so as to be capable of engaging the cavity wall; and (e) means for supporting and holding said base, expansible, and engaging means with respect to one another for unitary removal from said cavity upon the releasing of said forces, said support means comprises a rigid element for joining said base means and said expansible means to said securing means without the cavity; said rigid member extending within the cavity and without so as to engage said expansible means and provide support to said rigid element with the cavity, said rigid member having an intergrally formed laterally extending flange-like portion for bearing against the marginal edge of the cavity wall for keeping the support means from pivotally moving about the marginal edge; and (f) receptacle means secured to said engaging member for receiving therein the stanchion; said receptacle means comprises leg-like extensions engageable with the work area so as to space said receptacle from the marginal edge of the cavity.

3. Support means as recited in claim 2 wherein said receptacle has a rectangular cross section and a planar base.

4. Support means for stanchions or the like of the type having at least a portion thereof insertable within a cavity, the cavity having a predetermined configuration, said support means comprising:

(a) base means for insertion within a cavity;

(b) expansible means comprises, a threaded rod a toroidal collar made of rubber about said threaded rod, upon said base means, for insertion within the cavity; said base means comprises a rigid disk for supporting thereon said expansible means and a rigid upright member; said rigid upright member comprises a threaded rod;

(c) engaging means coupled to said base means and expansible means, said engaging means and said base means are on opposed sides of said expansible means, such that upon said engaging means exerting a force against said expansible means, said base means, in response to said engaging means, exerts a force against said expansible means; said combined forces thereby causing said expansible means to expand so as to be capable of engaging the cavity wall; said engaging means is coupled to said upright member and comprises a rigid sleeve about said rod and means coupled to said rigid upright member to transmit forces to said rigid member; said expansible means is easily insertable within the cavity in a relaxed condition and returns to said relaxed condition upon removing said forces of said engaging means and said base means; and (d) means for coupling to a stanchion for engaging said threaded rod and forcing said sleeve against said collar; said coupling means comprises a nut integral with said stanchion and threaded upon said threaded rod, such that upon tightening said nut against said sleeve, said sleeve engages said collar, said sleeve having a radially extending flange portion for bearing against the marginal edge of the cavity wall and keeping the stanchion from pivotally moving about the marginal edge, said flange portion having arms extending therefrom for securing thereot to a toe board.

5. Support means for stanchions or the like of the type having at least a portion thereof insertable within a cavity, the cavity having a predetermined configuration, said support means comprising:

(a) base means for insertion within a cavity;

(b) expansible means, upon said base means, for insertion within the cavity; said base means comprises a rigid member for supporting thereon said expansible means and an upright member;

(c) engaging means coupled to said base means and expansible means, said engaging means and said base means are on opposed sides of said expansible means, such that upon said engaging means exerting a force against said expansible means, said base means, in response to said engaging means, exerts a force against said expansible means; said combined forces thereby causing said expansible means to expand so as to be capable of engaging the cavity wall; said engaging means is coupled to said upright member; and (d) column securing means having means for holding guard rails secured thereto and coupled to said engaging means; said column securing mens comprises at least one planar member having at least one guard rail bracket secured thereto and secured to said engaging means such that said planar portion thereof is perpendicular to said engaging means.

* * * * *